US007988571B2

(12) United States Patent
Aoyama

(10) Patent No.: US 7,988,571 B2
(45) Date of Patent: Aug. 2, 2011

(54) GOLF BALL WITH POLYGONAL DIMPLE GROUPINGS

(75) Inventor: Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 160 days.

(21) Appl. No.: 12/210,553

(22) Filed: Sep. 15, 2008

(65) Prior Publication Data

US 2010/0069176 A1 Mar. 18, 2010

(51) Int. Cl.
*A63B 37/12* (2006.01)

(52) U.S. Cl. ..... 473/383

(58) Field of Classification Search ..... 473/383–385
See application file for complete search history.

(56) References Cited

U.S. PATENT DOCUMENTS

| | | | | |
|---|---|---|---|---|
| 6,162,136 | A | 12/2000 | Aoyama | |
| 6,991,564 | B2 * | 1/2006 | Sajima | 473/383 |
| 7,018,309 | B2 * | 3/2006 | Kasashima et al. | 473/383 |
| 7,160,212 | B2 * | 1/2007 | Sato et al. | 473/383 |

* cited by examiner

*Primary Examiner* — Raeann Trimiew
(74) *Attorney, Agent, or Firm* — Mandi B. Milbank

(57) ABSTRACT

The present invention concerns a golf ball having dimple groupings comprised of multiple angular spiral shaped arms that are arrayed to form polygonal perimeters, wherein the number of arms equals the number of perimeter sides. This allows greater symmetry about the dimple grouping center, thereby improving the consistency of the aerodynamic performance of the ball. In another unique feature of the present invention, the angular shape of the arms facilitates the formation of polygonal shaped dimple groupings, which can fit closely together to cover a greater proportion of the ball's surface, preferably more than about 85% surface coverage, thereby further enhancing aerodynamic performance.

2 Claims, 9 Drawing Sheets

GOLF BALL WITH POLYGONAL DIMPLE GROUPINGS

FIELD OF THE INVENTION

The present invention relates to golf balls, and more particularly, to golf balls having dimple groupings comprised of multiple angular spiral shaped arms that are arrayed to form substantially polygonal perimeters, wherein the number of arms matches the number of sides.

BACKGROUND OF THE INVENTION

Golf balls generally include a spherical outer surface with a plurality of dimples formed thereon. Conventional dimples are circular depressions that reduce drag and increase lift. These dimples are formed where a dimple wall slopes away from the outer surface of the ball forming the depression.

Drag is the air resistance that opposes the golf ball's flight direction. As the ball travels through the air, the air that surrounds the ball has different velocities thus, different pressures. The air exerts maximum pressure at a stagnation point on the front of the ball. The air then flows around the surface of the ball with an increased velocity and reduced pressure. At some separation point, the air separates from the surface of the ball and generates a large turbulent flow area behind the ball. This flow area, which is called the wake, has low pressure. The difference between the high pressure in front of the ball and the low pressure behind the ball slows the ball down. This is the primary source of drag for golf balls.

The dimples on the golf ball cause a thin boundary layer of air adjacent to the ball's outer surface to flow in a turbulent manner. Thus, the thin boundary layer is called a turbulent boundary layer. The turbulence energizes the boundary layer and helps move the separation point further backward, so that the layer stays attached further along the ball's outer surface. As a result, a reduction in the area of the wake, an increase in the pressure behind the ball, and a substantial reduction in drag are realized. It is the circumference of each dimple, where the dimple wall drops away from the outer surface of the ball, which actually creates the turbulence in the boundary layer.

Lift is an upward force on the ball that is created by a difference in pressure between the top of the ball and the bottom of the ball. This difference in pressure is created by a warp in the airflow that results from the ball's backspin. Due to the backspin, the top of the ball moves with the airflow, which delays the air separation point to a location further backward. Conversely, the bottom of the ball moves against the airflow, which moves the separation point forward. This asymmetrical separation creates an arch in the flow pattern that requires the air that flows over the top of the ball to move faster than the air that flows along the bottom of the ball. As a result, the air above the ball is at a lower pressure than the air underneath the ball. This pressure difference results in the overall force, called lift, which is exerted upwardly on the ball. The circumference of each dimple is important in optimizing this flow phenomenon, as well.

By using dimples to decrease drag and increase lift, almost every golf ball manufacturer has increased their golf ball flight distances. In order to optimize ball performance, it is desirable to have a large number of dimples, hence a large amount of dimple circumference, which is evenly distributed around the ball. In arranging the dimples, an attempt is made to minimize the space between dimples, referred to herein as "land area," because the land area does not improve aerodynamic performance of the ball. In practical terms, this usually translates into 300 to 500 circular dimples with a conventional sized dimple having a diameter that typically ranges from about 0.100 inches to about 0.180 inches.

One attempt to improve the aerodynamic performance of golf balls is suggested in U.S. Pat. No. 6,162,136 ("the '136 patent"), assigned to the Acushnet Company, wherein a preferred solution is to minimize the land surface or undimpled surface of the ball. The '136 patent also discloses that this minimization should be balanced against the durability of the ball. Since as the land surface decreases, the susceptibility of the ball to premature wear and tear by impacts with the golf club increases.

Another attempt to improve the aerodynamic performance of golf ball is suggested in commonly owned U.S. patent application Ser. No. 11/738,755 ("the'755 application"), which discloses a golf ball comprising a plurality of dimple groupings comprising one or more spiral shaped depressions with a single smoothly curved arm. The spiral shaped depressions are arrayed to form a generally rounded or circular perimeter shape. With such circular dimple groupings, golf ball surface coverage is typically limited to a maximum of about 85%. The '755 application does disclose generally polygonal perimeter shapes, i.e., a triangular dimple or a square dimple, with such groupings consisting of a polygonal depression with a single spiral depression superimposed inside.

Hence, there remains a need in the art for a golf ball with at least one non-circular dimple grouping that has a high dimple coverage and superior aerodynamic performance.

SUMMARY OF THE INVENTION

Accordingly, provided herein is a dimple grouping with a generally polygonal perimeter (including but not limited to triangles, squares, pentagons, hexagons, and other generally polygonal shapes) comprising $n_1$ sides and a plurality of angular arms $n_2$, wherein each angular arm comprises at least one generally straight segment and one relatively sharp corner of less than 180°. In an innovative aspect of the invention, $n_1$ equals $n_2$.

Also provided herein is a golf ball that includes a generally spherical surface with a plurality of dimple groupings, wherein at least one dimple grouping comprises a generally polygonal perimeter comprising $n_1$ sides and a plurality of angular arms $n_2$, wherein $n_1$ equals $n_2$. Optionally, one or more of the dimple groupings can be filled with one or more circular dimples. The dimple groupings can be arranged in a pattern selected from the group including, but not limited to, icosahedrons, truncated icosahedrons, octahedrons, dodecahedrons, icosidodecahedrons, and dipyramids.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
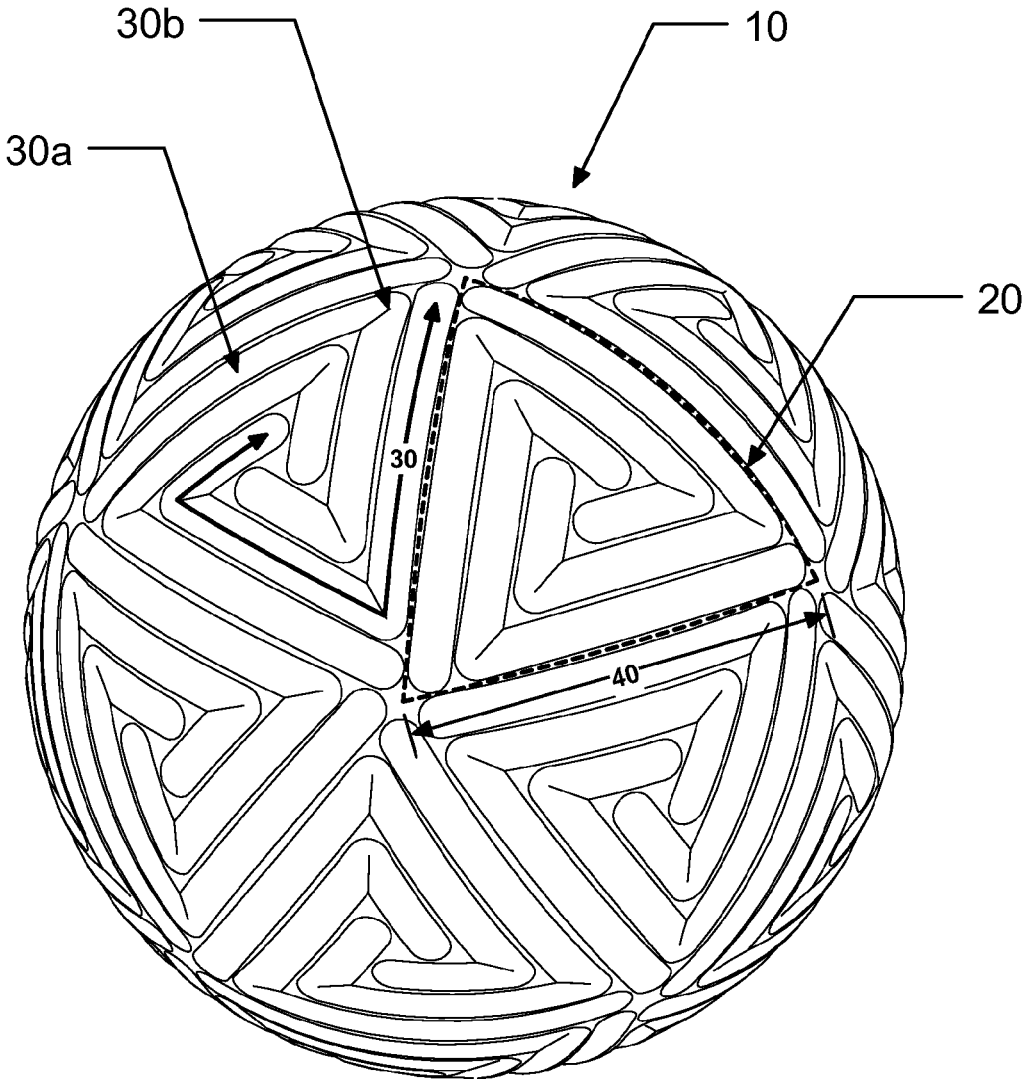
FIG. 1 is a perspective view of a golf ball having triangular dimple groupings arranged thereupon in an icosahedron pattern according to an embodiment of the present invention.

As illustrated in FIG. 1, the present invention concerns a golf ball 10 having dimple groupings 20 comprised of multiple angular spiral shaped arms 30 that are arrayed to form generally polygonal perimeters, wherein the number ($n_1$) of arms 30 equals the number ($n_2$) of perimeter sides 40. For example, a triangular dimple grouping 20, as shown in FIG. 1, has three arms 30 and three sides 40, and a square dimple grouping (not shown) would have four arms and four sides. The condition that the number of arms 30 should match the number of perimeter sides 40 is an innovative aspect of the present invention that allows greater symmetry about the dimple grouping center, thereby improving the consistency of the aerodynamic performance of the ball. In another unique feature of the present invention, the angular shape of arms 30 facilitates the formation of polygonal shaped dimple groupings 20, which can fit closely together to cover a greater proportion of the ball's surface, preferably more than 80%, preferably more than about 85% and up to about 90% surface coverage, thereby further enhancing aerodynamic performance.

The term "dimple grouping" is defined herein to mean a collection of inventive angular spiral arms, conventional circular dimples, other aerodynamic devices (e.g., indentations, depressions, grooves, or even projections), and combinations thereof.

Dividing the spherical surface of a golf ball into spherical polygonal areas is a well-known procedure in the development of conventional dimple patterns. Usually, this involves inscribing a regular or semi-regular polyhedron inside the sphere and projecting the edges onto the spherical surface. Most commonly, the polyhedron is a regular icosahedron, resulting in twenty (20) spherical triangular areas to be used as repeating elements of the dimple grouping pattern. Other common base polyhedrons include, but are not limited to, octahedrons (8-sided polyhedrons), dodecahedrons (12-sided polyhedrons), icosidodecahedrons (polyhedrons with twenty triangular faces and twelve pentagonal faces), and various dipyramids (polyhedrons formed from two n-agonal pyramids placed symmetrically base-to-base). The resulting polygonal areas can be subdivided into smaller areas using techniques similar to those employed for the development of geodesic domes.

As illustrated in FIG. 1, in the present invention, rather than filling the polygonal areas with arrays of circular dimples, each polygonal area is a dimple grouping 20 comprising angular spiral shaped arms 30 in the form of depressions or grooves. The number of arms 30 matches the number of sides 40 of the polygonal dimple grouping 20. Each arm 30 has at least one relatively straight section 30*a* at its extremity that forms one of the sides 40 of the dimple grouping area 20, and at least one comparatively sharp corner 30*b*. Preferably, corner 30*b* measures less than about 180° and more preferably less than about 90°. FIG. 1 shows an example based on an icosahedron. Each of the twenty (20) icosahedron triangles is filled with a grouping of three angular spiral arms 30, wherein each arm comprises three relatively straight segments 30*a* connected by two corners 30*b*.

Figure 2:
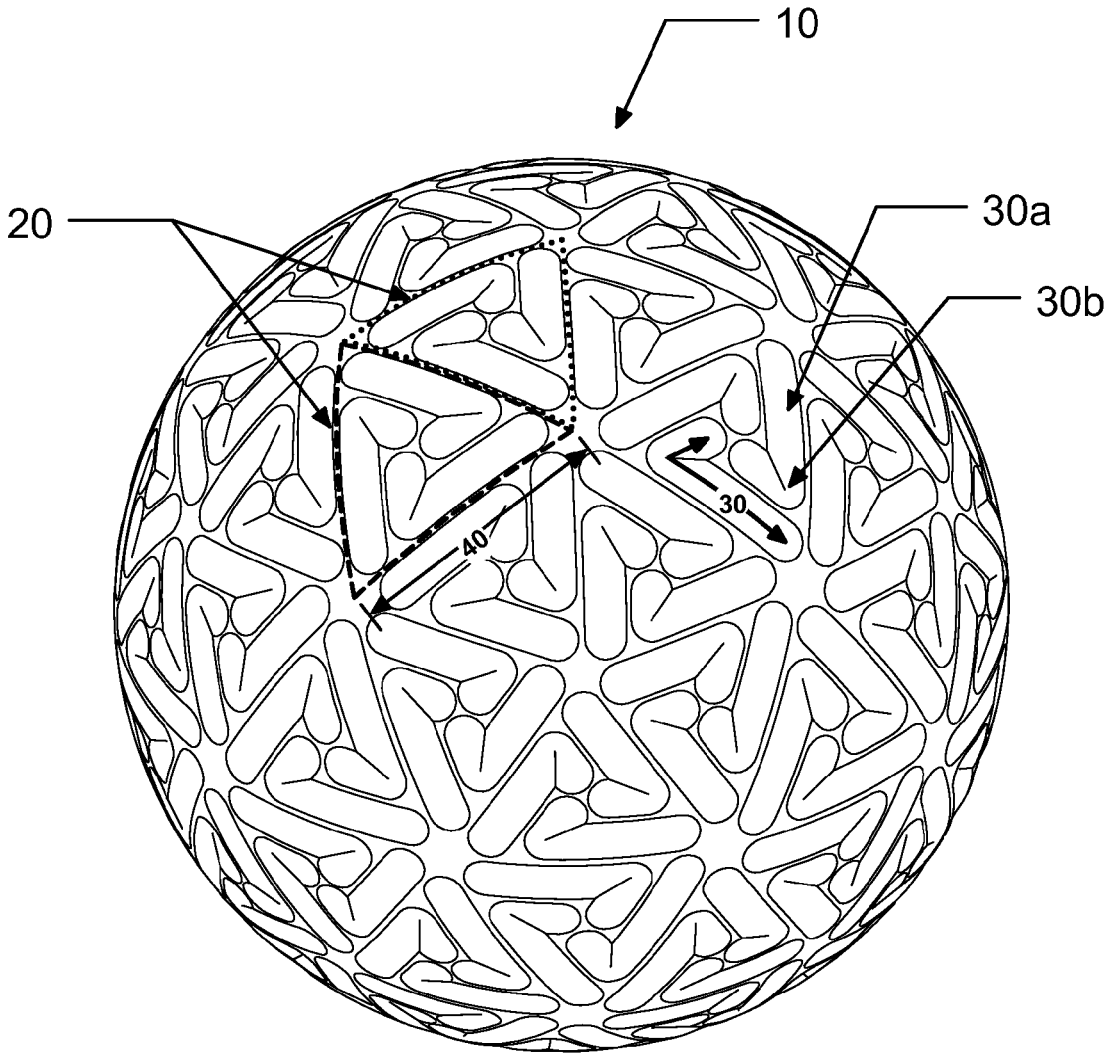
FIG. 2 is a perspective view of a golf ball having triangular dimple groupings arranged thereupon in an icosahedron pattern according to another embodiment of the present invention.

Each of the icosahedron triangles in FIG. 1 can be subdivided using geodesic techniques into four smaller triangles for aerodynamic and/or aesthetic reasons. This produces a total of eighty (80) smaller triangular dimple groupings 20 in two different sizes, as shown in FIG. 2, which are each filled with three angular spiral arms 30. Because the triangles are smaller, the arms 30 in this case comprise only two relatively straight segments 30*a* connected by one corner 30*b*.

Figure 3:
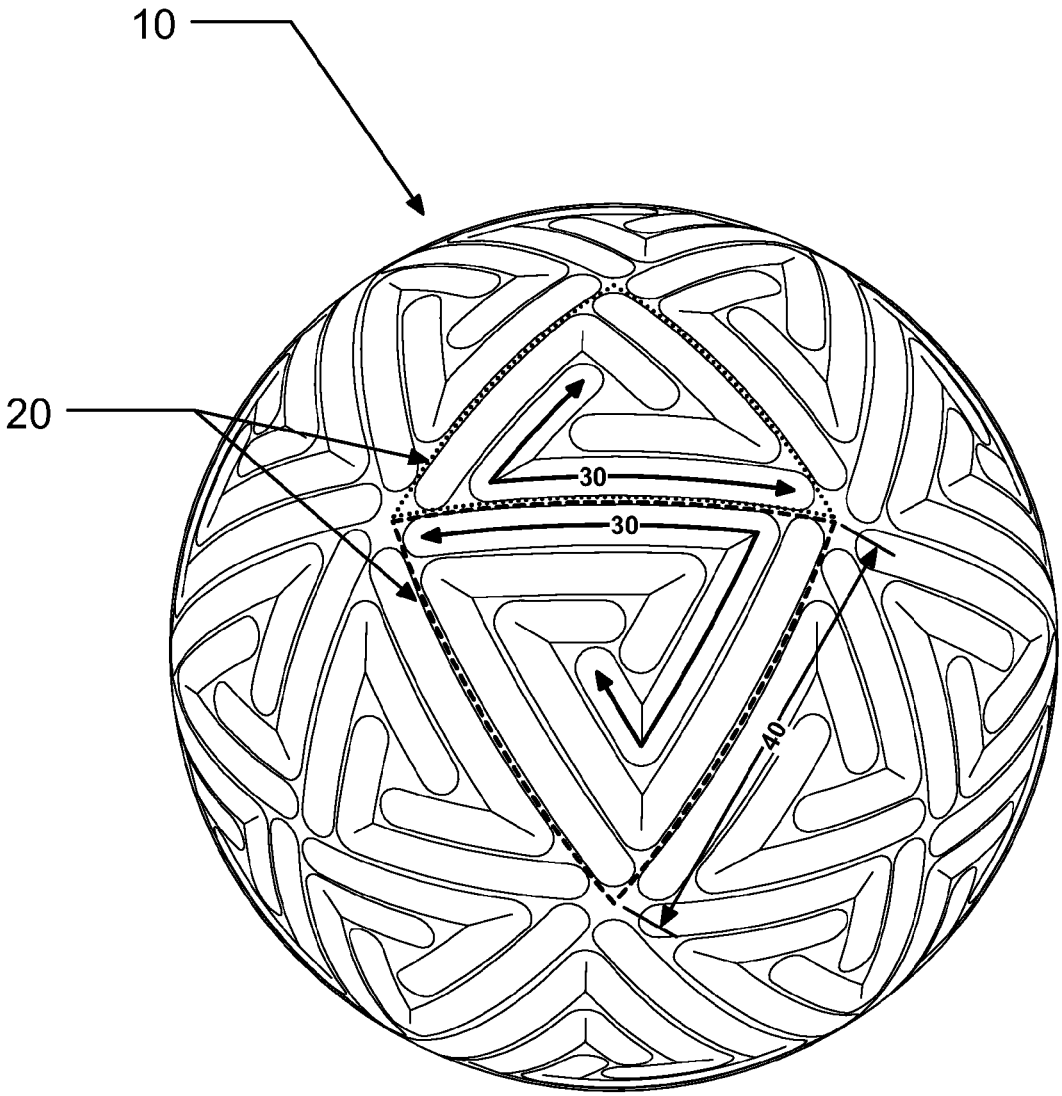
FIG. 3 is a perspective view of a golf ball having triangular dimple groupings arranged thereupon in an octahedron pattern according to yet another embodiment of the present invention.

FIG. 3 shows yet another embodiment of dimple groupings 20 according to the present invention. This embodiment is based on an octahedron pattern, with each of the eight octahedral triangles subdivided into four smaller triangles, producing thirty-two (32) triangular dimple groupings 20, wherein said triangular dimple groupings 20 have two different sizes. The larger triangular groupings 20 comprise three three-segment arms 30, while the smaller triangular groupings 20 comprise three two-segment arms 30.

Figure 4:
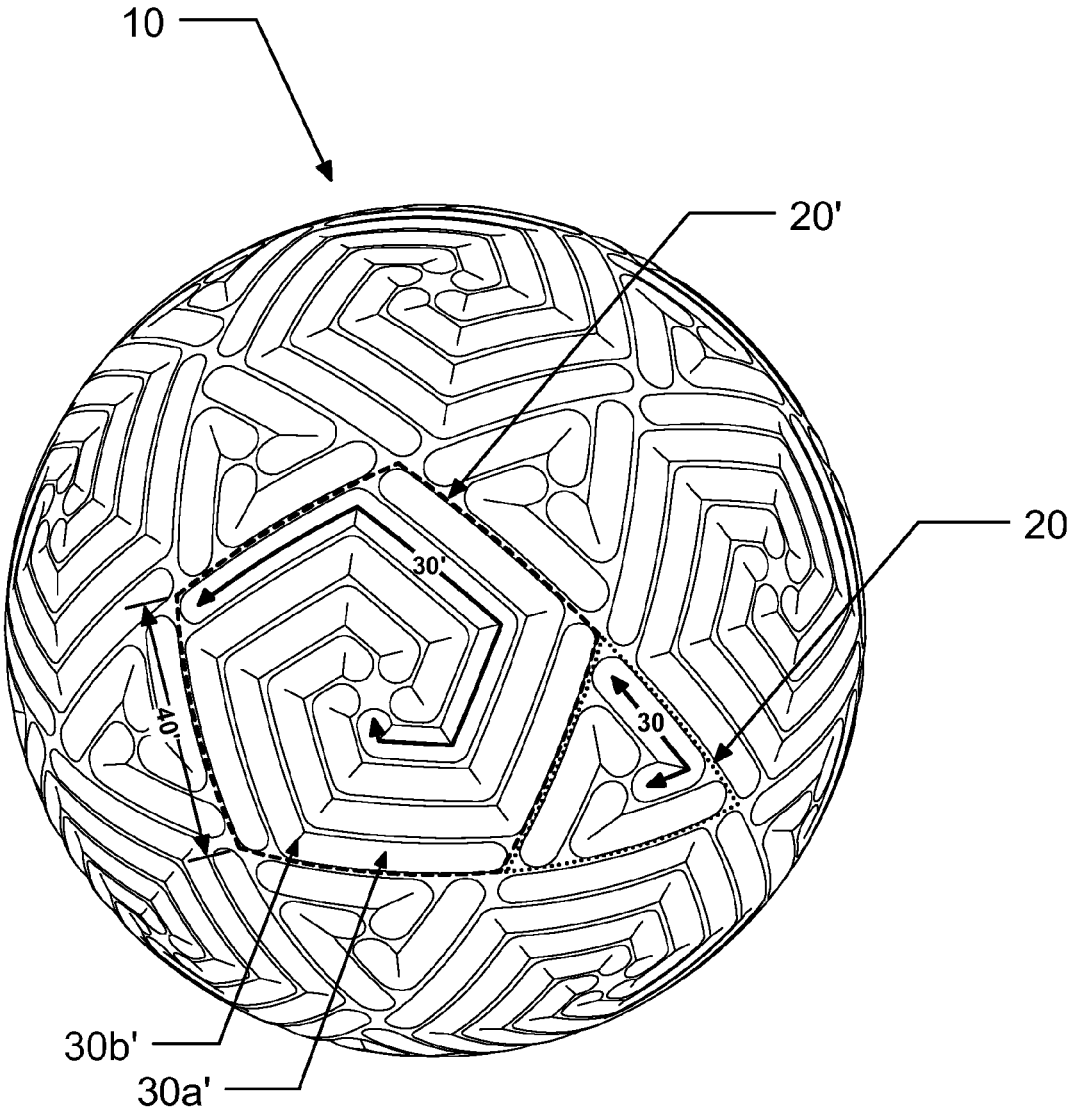
FIG. 4 is a perspective view of a golf ball having triangular and pentagonal dimple groupings arranged thereupon in an icosidodecahedron pattern according to yet another embodiment of the present invention.

FIG. 4 shows yet another embodiment of dimple groupings 20, 20' according to the present invention. This embodiment is based on an icosidodecahedron pattern comprising twenty (20) triangular dimple groupings 20 and twelve (12) pentagonal dimple groupings 20'. The triangular dimple groupings 20 are comparable to the triangular dimple groupings 20, illustrated in FIG. 2, each comprising three two-segment arms 30. Each of the pentagonal dimple groupings 20' comprises five arms 30', wherein each arm comprises five relatively straight segments 30*a'* connected by four corners 30*b'*.

Figure 5:
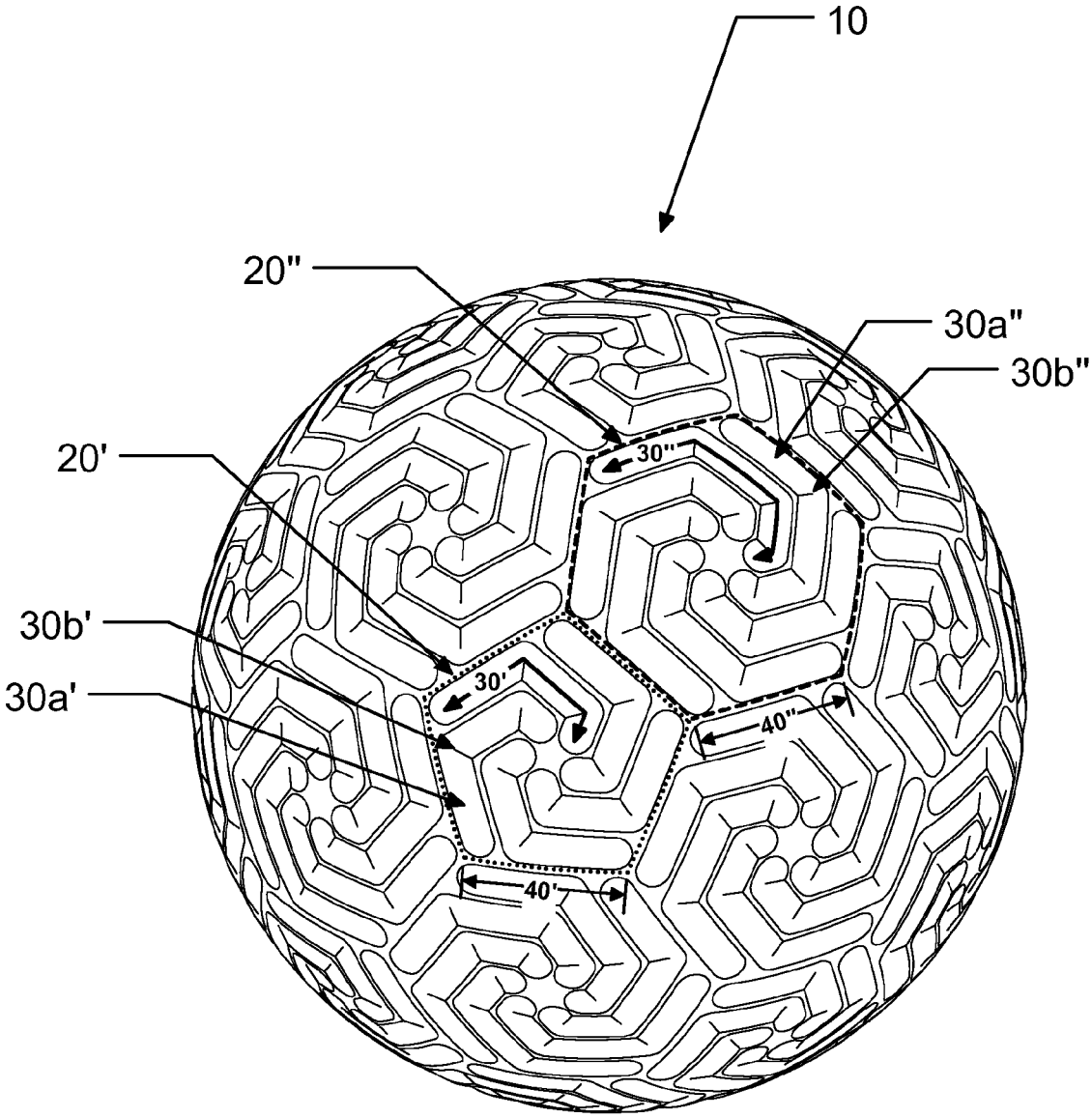
FIG. 5 is a perspective view of a golf ball having pentagonal and hexagonal dimple groupings arranged thereupon in a truncated icosahedron pattern according to yet another embodiment of the present invention.

FIG. 5 shows yet another embodiment of dimple groupings 20', 20" according to the present invention. This embodiment is based on a truncated icosahedron pattern comprising twelve (12) pentagonal dimple groupings 20' and twenty (20) hexagonal dimple groupings 20". Triangular dimple groupings 20, as illustrated in FIGS. 1-4, are absent from this embodiment. Each of the pentagonal dimple groupings 20' comprises five three-segment arms 30', wherein each arm comprises three relatively straight segments 30*a'* connected by two corners 30*b'*. Each of the hexagonal dimple groupings 20" comprises six four-segment arms 30", wherein each arm comprises four relatively straight segments 30*a"* connected by three corners 30*b"*.

Figure 6:
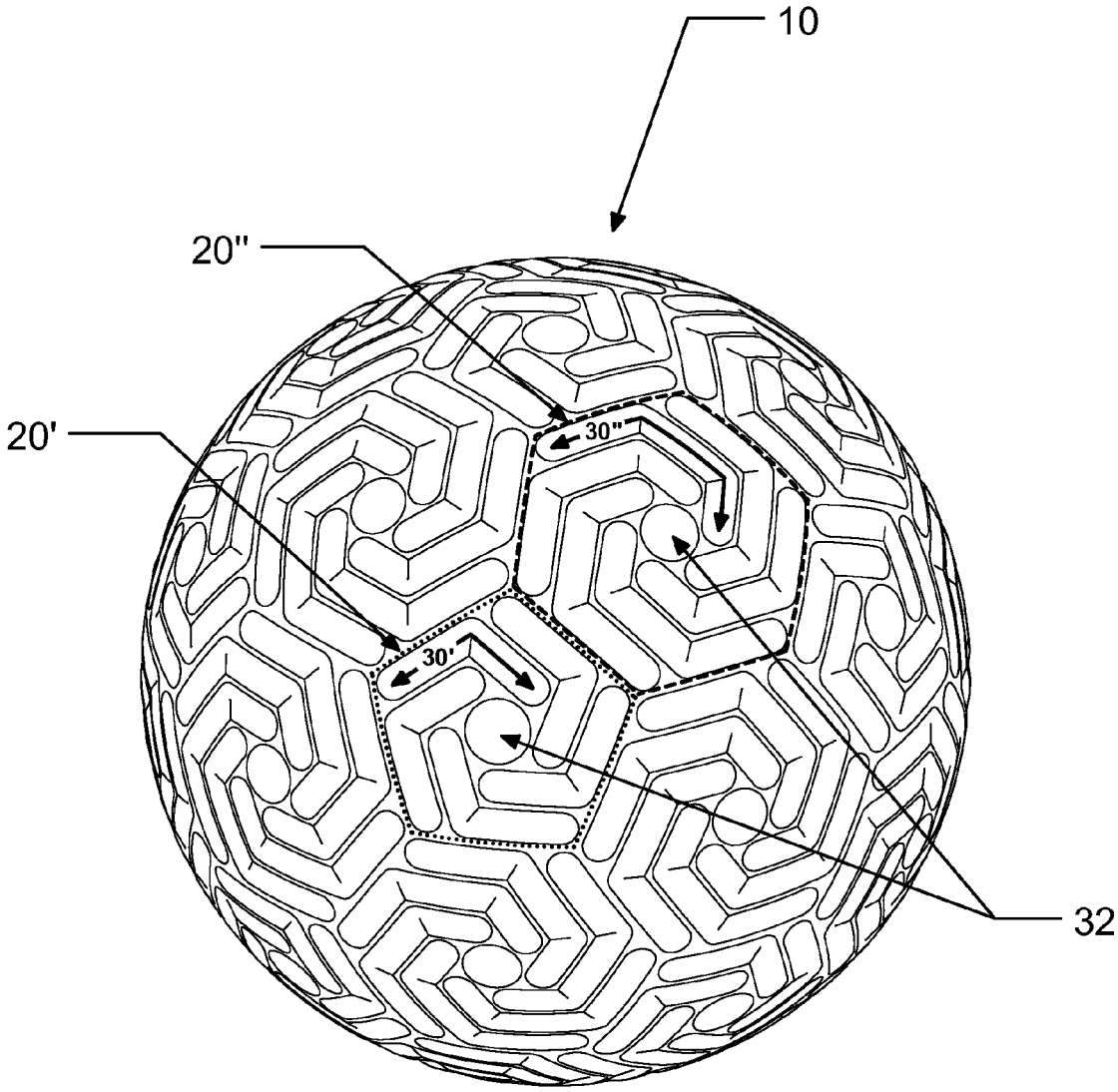
FIG. 6 is a perspective view of a golf ball having pentagonal and hexagonal dimple groupings arranged thereupon in a truncated icosahedron pattern according to yet another embodiment of the present invention.

The polygonal dimple groupings 20, 20', 20" can be comprised of other aerodynamic devices besides spiral arms 30, 30', 30", including, but not limited to, conventional circular dimples 32. FIG. 6 illustrates an embodiment of dimple groupings 20', 20" based on the truncated icosahedron pattern of FIG. 5. The innermost segment of each spiral arm 30', 30" has been replaced by a conventional circular dimple 32 at the center of each pentagonal dimple grouping 20' and each hexagonal dimple grouping 20".

Figure 7:
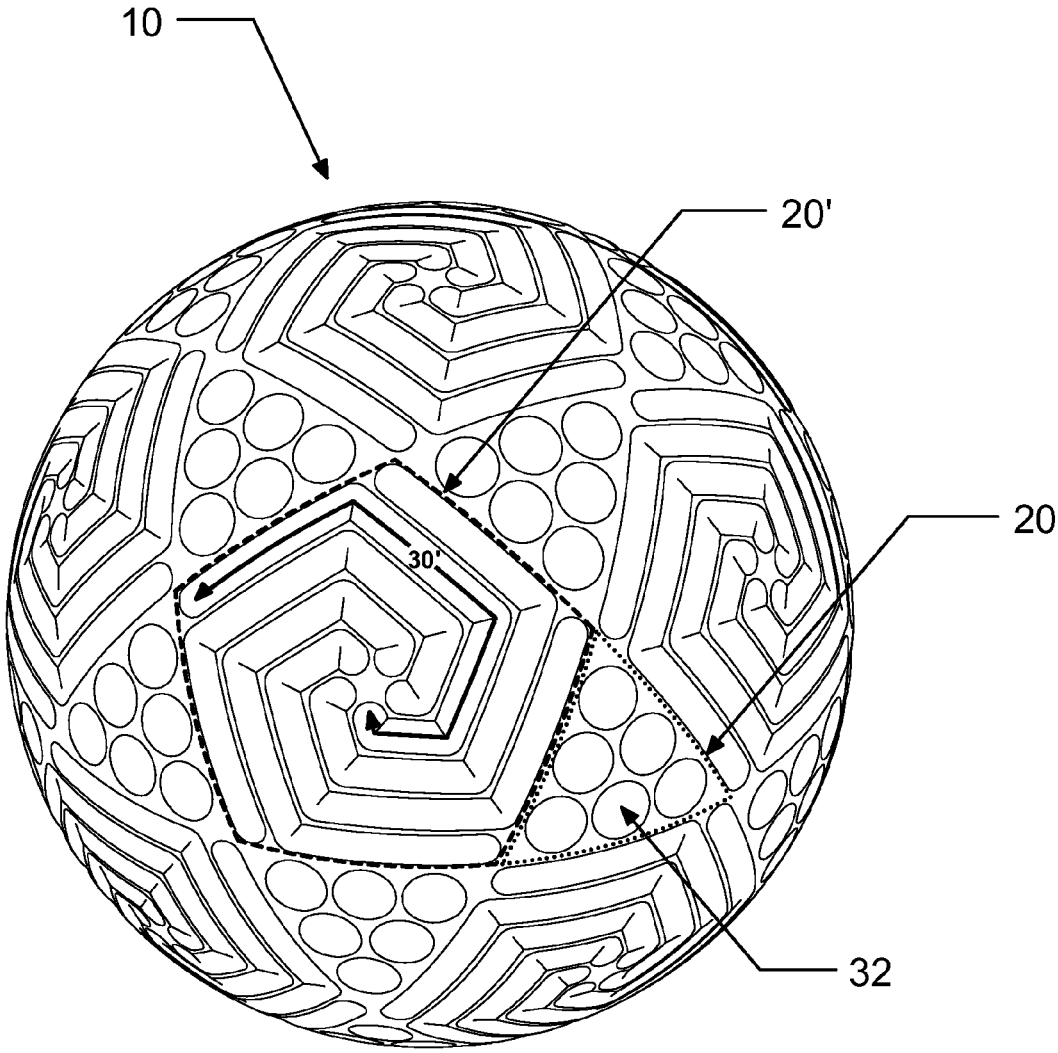
FIG. 7 is a perspective view of a golf ball having triangular and pentagonal dimple groupings arranged thereupon in a icosidodecahedron pattern according to yet another embodiment of the present invention.

FIG. 7 illustrates an embodiment of dimple groupings 20, 20' based on the icosidodecahedron pattern of FIG. 4. Each of the twenty (20) triangular dimple groupings 20 is filled with conventional circular dimples 32. Each of the twelve (12) pentagonal dimple groupings 20' comprises five five-segment arms 30'.

Figure 8:
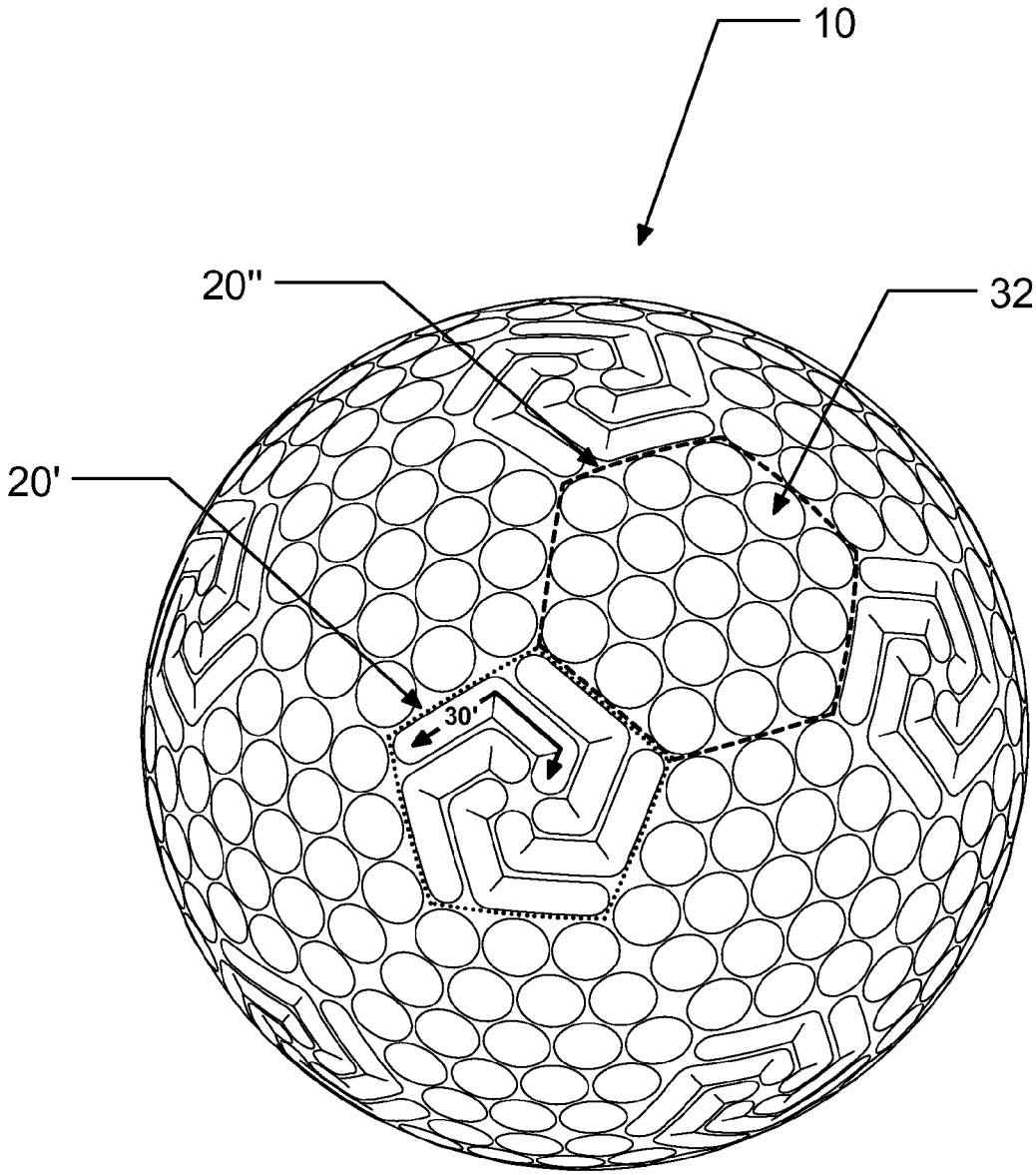
FIG. 8 is a perspective view of a golf ball having pentagonal and hexagonal dimple groupings arranged thereupon in a truncated icosahedron pattern according to yet another embodiment of the present invention.

FIG. 8 illustrates an embodiment of dimple groupings 20', 20" based on the truncated icosahedron pattern of FIG. 5. In this embodiment, the twenty (20) hexagonal dimple groupings 20" are filled with conventional circular dimples 32, resulting in a majority of the golf ball surface being filled with said circular dimples 32. The twelve (12) pentagonal dimple groupings 20' comprise five three-segment arms 30'.

Figure 9:
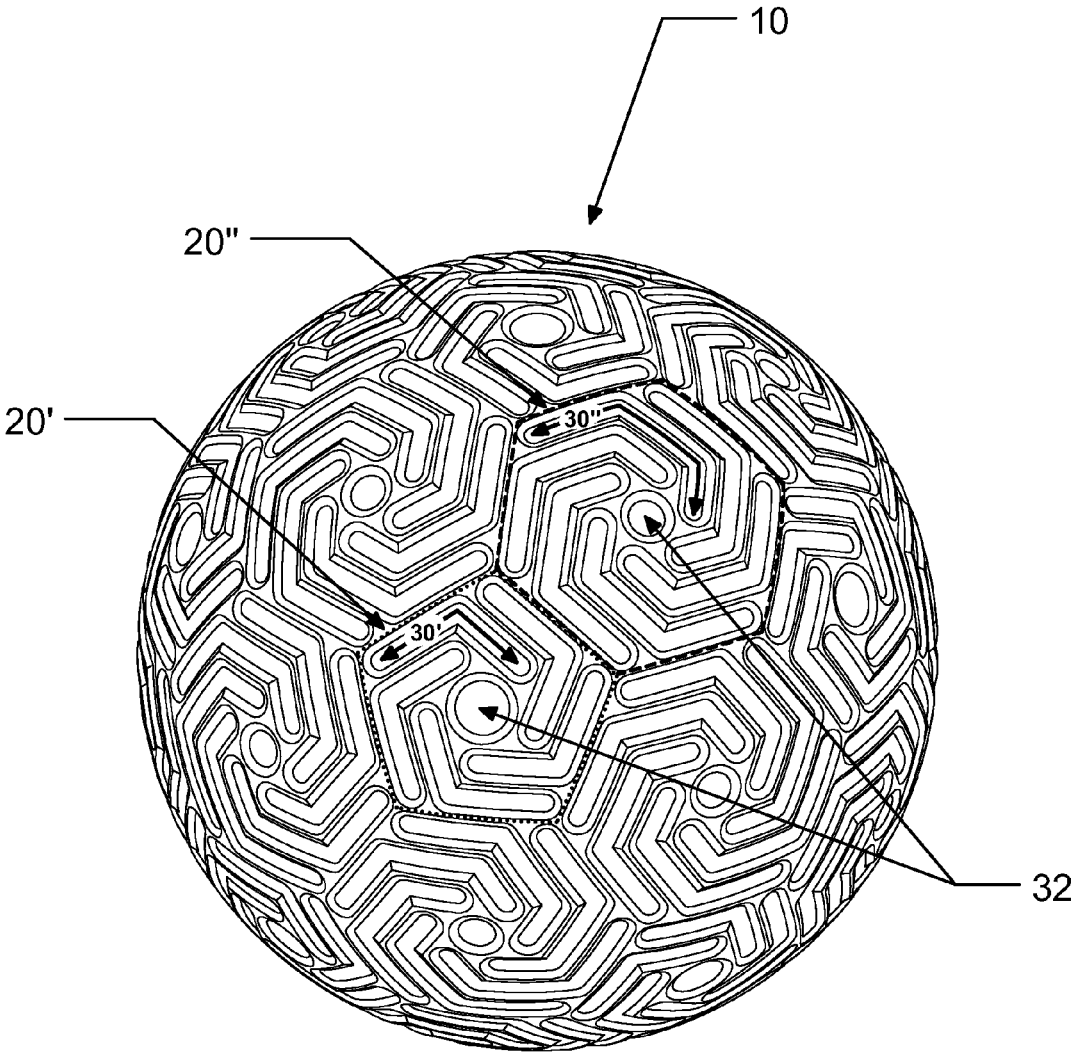
FIG. 9 is a perspective view of a golf ball having pentagonal and hexagonal dimple groupings arranged thereupon in a truncated icosahedron pattern according to yet another embodiment of the present invention.

FIGS. 1-8 illustrate inventive arms 30, 30', 30" and circular dimples 32 with simple circular arc cross-sectional shapes. However, there is no particular restriction on this, and any suitable cross-sectional shape can be used. For example, FIG. 9 illustrates an embodiment of dimple groupings 20', 20" based on the truncated icosahedron pattern of FIG. 6. In this embodiment, the arms 30', 30" and the circular dimples 32 both have a truncated flat-bottomed shape. Furthermore, the cross-sectional shape, width, and depth may vary along the length of the arm. The cross-sectional shape can also be catenary, elliptical, among others.

The present invention also contemplates other embodiments. For instance, dimple groupings 20, 20', 20" can comprise arms 30, 30', 30" that are connected at their innermost ends to form a hub-like junction. Similarly, although the spiral arms 30, 30', 30" are described as angular, it is only required that the outermost segment of each arm be relatively straight, and that each arm include at least one relatively sharp corner.

While various descriptions of the present invention are described above, it is understood that the various features of the embodiments of the present invention shown herein can be used singly or in combination thereof. The dimple groupings of the present invention can be incorporated into other types of objects in flight. Additionally, a plurality of dimple groupings having different configurations such as the various embodiments described above can be incorporated on a single golf ball. This invention is also not to be limited to the specifically preferred embodiments depicted therein.

The invention claimed is:

1. A golf ball comprising:

a generally spherical surface; and a plurality of dimple groupings formed on the surface;

wherein at least one dimple grouping comprises a generally polygonal perimeter comprising $n_1$ sides and a plurality of angular arms $n_2$, wherein each angular arm comprises at least one generally straight segment and at least one relatively sharp corner, wherein $n_1$ equals $n_2$, wherein the plurality of dimple groupings is arranged in an icosidodecahedron pattern comprising twenty triangles and twelve pentagons, and wherein each of the twenty triangles comprises three angular arms comprising two relatively straight segments and one relatively sharp corner, and wherein each of the twelve pentagons comprises five angular arms comprising five relatively straight segments and four relatively sharp corners.

2. The golf ball of claim 1, wherein the dimple groupings cover more than about 85% of the spherical surface.

* * * * *